United States Patent [19]

Pearson

[11] 4,389,963

[45] Jun. 28, 1983

[54] APPARATUS AND METHOD FOR MONITORING PERIODIC DISPENSATION OF PILLS

[76] Inventor: Richard W. Pearson, Ridge Rd., Chester, Conn. 06412

[21] Appl. No.: 247,806

[22] Filed: Mar. 26, 1981

[51] Int. Cl.[3] ..... A61J 7/00; G09F 7/18

[52] U.S. Cl. ..... 116/308; 116/309; 116/DIG. 46; 206/305; 206/459; 283/1

[58] Field of Search ..... 116/308, 325; 206/534, 206/379, 305; 283/1; 312/283

[56] References Cited

U.S. PATENT DOCUMENTS

| | | | |
|---|---|---|---|
| 620,013 | 2/1899 | Barnes | 312/283 |
| 630,822 | 8/1899 | Bates | 116/308 X |
| 692,166 | 1/1902 | Schaffer | 116/308 |
| 1,716,868 | 6/1929 | Stephens | 211/133 X |
| 1,958,517 | 5/1934 | Low | 40/312 X |
| 1,963,544 | 6/1934 | Burt | 40/493 X |
| 2,512,485 | 6/1950 | Cougias | 35/25 |
| 3,675,620 | 7/1972 | Baustin | 116/308 |
| 3,727,771 | 4/1973 | Hoffman | 206/379 |
| 3,841,260 | 10/1974 | Sharp et al. | 116/136 |
| 4,000,814 | 1/1977 | Stout | 40/312 |
| 4,004,691 | 1/1977 | Wihksne | 40/312 X |
| 4,148,273 | 4/1979 | Hollingworth et al. | 116/325 |

*Primary Examiner*—Daniel M. Yasich

*Attorney, Agent, or Firm*—C. G. Nessler

[57] ABSTRACT

Disclosed is a way by which a person may keep track of consumption of pills, or dispensation of other articles. A box receptacle is used to store pill bottles, each marked with a different symbol. Designations of time periods at which pills are scheduled for consumption are marked on the sides of the box, spaced apart so that only one designation may be made principally visible by rotation of the box. Affixed to the sides of the box at the designations are tags corresponding with the symbols marked on the individual bottles, to indicate by type and number, if desired, the pills to be taken. After consuming the pills at a scheduled time the user rotates the box so that the next scheduled time is visible, thereby providing a later reminder if the user forgets if the pills were taken as scheduled.

8 Claims, 9 Drawing Figures

FIG. 1
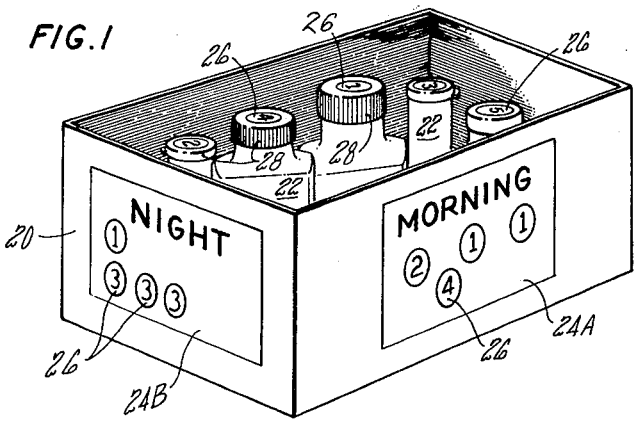
FIG. 2
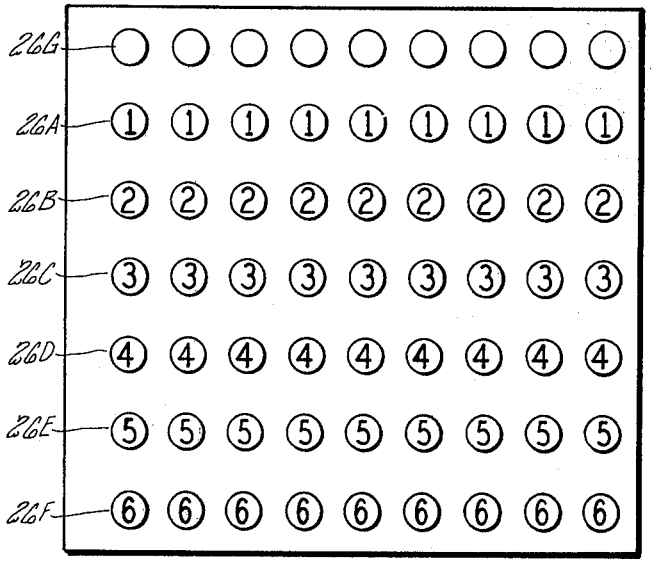
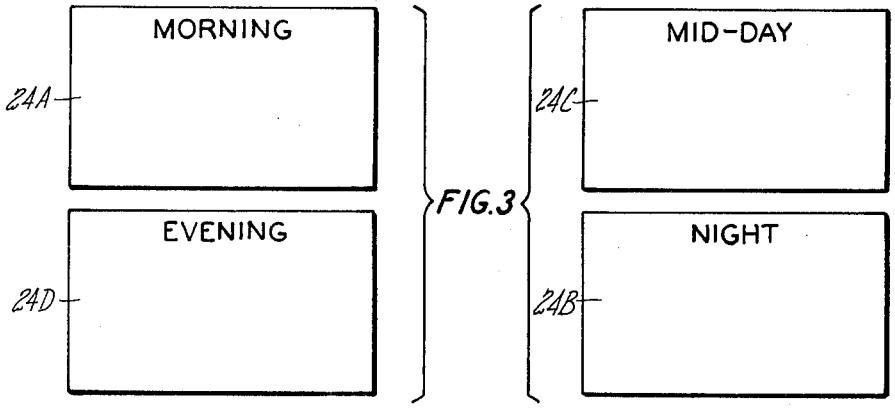
FIG. 3

FIG. 4
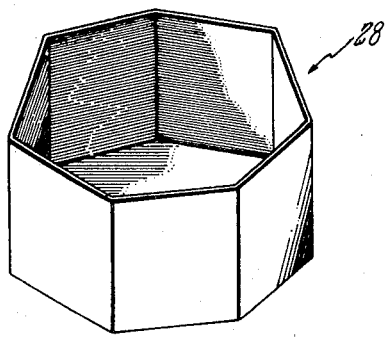
FIG. 5
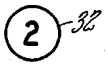
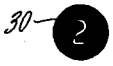
FIG. 6
FIG. 7
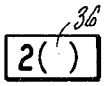
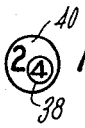
FIG. 8
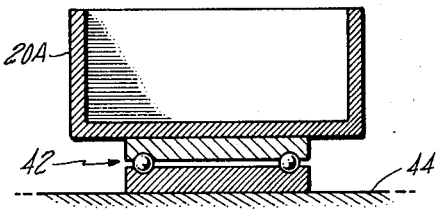
FIG. 9

APPARATUS AND METHOD FOR MONITORING PERIODIC DISPENSATION OF PILLS

BACKGROUND OF THE INVENTION

1. The present invention relates to devices for scheduling and monitoring the dispensation of articles, such as medicines and pills.

2. Many people are required to ingest medicines, vitamins, and the like on a periodic basis. Because such consumption becomes a very routine and repetitive undertaking, it is common to find that a person cannot remember whether he has lately taken his scheduled dosage. For instance, a person of regular but not fastidious habits may find himself shortly after breakfast trying to recall whether he took at breakfast his regimen of pills. A further but lesser failing is that the person cannot remember how much of a particular consumable he is to take, especially when such information is omitted from the label of the bottle holding it.

Of course, the foregoing are problems that have been long recognized. But it has not been sufficient for a person to simply concentrate, or to make a written log or other record; the latter no doubt being due to the inconvenience. Mechanical apparatuses to aid in the recording and reminding about the consumption of medicines have been available heretofore. Cougias U.S. Pat. No. 2,512,485 discloses a system whereby daily toothbrush use may be kept track of by movement of tags on a wall mounted pegboard. Sharp et al. U.S. Pat. No. 3,841,260 discloses a pegboard system whereupon coded pegs are moved upon a matrix board to record consumption of foodstuffs. The pegs are color coded to aid in the monitoring function. A disadvantage of the foregoing system is that the pegs can be easily lost and not readily replaced, thereby rendering the system less useful. Similarly, Hollingworth et al. U.S. Pat. No. 4,148,273 discloses a device which also uses color coded pegs which are moved and rotated upon a board. Again, the arrangement has the disadvantage of relying upon the particular pegs. Furthermore, both the foregoing methods involve devices which are not readily stored with the medicines if made large, and if made small they present problems to people with limited dexterity.

Other devices are known for specific use with pills. For example, a container may have a multiplicity of compartments, identified according to the time period at which the pills are to be taken. The user fills each compartment beforehand with the pills to be taken at each scheduled time. Thereafter he removes them from each designated compartment when the appropriate time arrives; whether pills have been taken becomes visually evident. While effective, this system requires periodic counting and transfer of pills from their normal containers into the compartments. Although seemingly a slight task, many persons are thereby inconvenienced. Further, the system is not adaptable to liquid medicines which are best kept in the containers in which they are provided. Accordingly, there is a need for an improved way of scheduling and monitoring; one which allows the articles being dispensed to remain in their original containers, which does not involve components which can be lost, and which is easily used without great dexterity.

SUMMARY OF THE INVENTION

An object of the invention is to provide a simple and understandable means for scheduling and monitoring the consumption of medicines and the like; one that is easily used, durable, and adaptable to different regimens.

According to the invention, the surface of a rotatable device has marked thereon designations of the time periods at which items such as pills are to be dispensed. The time period designations are spaced apart so that only one may be made principally visible from a particular lateral direction by proper rotation of the device. As an example, a cube will carry out the invention. When the person using the invention dispenses articles, he rotates the device to make principally visible a time period corresponding with the next scheduled time at which dispensation is to take place. Thus, if subsequent to a particular time for dispensation the user does not remember if dispensation was properly accomplished, he may approach the device and if it indicates the approximate present or past time period, he is reminded that he has not made the dispensation. If the forthcoming time period is indicated, then he is reminded that he has already made the dispensation.

In the preferred embodiment the device is a rectangular box adapted to receive vessels in which pills are supplied, and the vessels are identified with numbers to differentiate them. Numbers corresponding to the vessel markings are affixed to the side of the box according to the time periods when the pills are to be taken. When the time for consumption arrives, the user approaches the box and determines whether he has or has not taken the designated pills already, in the manner indicated above. If he has not taken the pills and thereupon commences to do so, he grasps the box and removes the vessels therefrom, to remove the pills. Thus, he is very desirably forced to move the device which is the monitor of his consumption. When he puts it back in place, such as on a storage shelf, he must be woefully neglectful not to rotate the box to the forthcoming time period. This situation is contrasted with that in which the device does not receive the vessels and the user may, due to inattention, fail to rotate the device.

In a convenient embodiment of the invention a choice of self-adhesive labels designating time periods is provided for the box. Similarly self-adhesive labels may be provided to conveniently tag the bottles and the sides of the box with the set numbers.

The invention is easily used by those having limited dexterity, such as the elderly, and by those with limited capability for coping with complexities. It is durable, and lacking in elements of a specialized nature which might be lost or destroyed.

The foregoing and other objects, features and advantages of the present invention will become more apparent from the following description of preferred embodiments and accompanying drawings.

BRIEF DESCRIPTION OF THE DRAWINGS

FIG. 1 shows a rectangular box containing pill bottles, with the box and bottles having various markings.

FIG. 2 shows sets of labels used to tag pill bottles and indicate the pill schedule by attachment to the side of the box of FIG. 1.

FIG. 3 illustrates labels which may be fastened to the side of the box to designate time periods at which pills are to be dispensed.

FIG. 4 shows a multi-sided box suitable for a weekly cycle of time periods.

FIG. 5 shows a conventional label from a set of FIG. 2.

FIG. 6 shows a reverse printed label usable as a subset of a set from FIG. 2.

FIG. 7 shows a variation in label appearance, comprising the use of a suffix position.

FIG. 8 shows another variation in label appearance, comprising the use of subscript.

FIG. 9 shows in cross section a box mounted on a rotary bearing.

DESCRIPTION OF THE PREFERRED EMBODIMENT

The invention is described in terms of the consumption of pills contained in bottles. However, it will be seen that the invention is equally applicable to the periodic dispensation of other articles, and to other situations where there is a need for monitoring of a desired schedule.

Referring to FIG. 1, the invention involves the use of a receptacle, such as the four sided open top box 20, adapted to receive bottles 22 or other like vessels in which pills are normally provided by pharmacists. To the sides of the box are fixed labels 24A, 24B (and 24C, 24D not visible) or other indicia, such as may be made by embossing, imprinting or the like. The labels indicate the periods when the pills are scheduled for consumption, e.g. morning, noon, evening, and night, as shown in FIG. 3. Smaller tags, self-adhesive paper labels 26 are also affixed to the sides of the receptacle. These tags are also able to be attached to the tops 28 or other exposed surfaces of the pill containers 22. The tags are provided in multiple sets having common features, with each set being differentiable from the other. As shown in FIG. 2, serial numeric marked sets of paper labels may be used. The sets are those marked with a common serial number, e.g., rows 26A-F.

In the use of the invention the pill consumer affixes a tag having a different number to each of the vessels, as shown in FIG. 1. Having done so, he then considers first the bottle having the label numeral 1. Knowing his designated schedule he affixes identical labels bearing the number "1" to the faces of the box designating the time periods when the particular pill is to be taken. He may, if he wishes, place on the face of the box a plurality of stickers, to show the number of pills to be taken at a particular time period. In similar fashion, he attaches labels to the other bottles and to the faces of the box. In FIG. 1, a schedule is thus indicated which comprises taking in the morning two pills from bottle 1, and one each from bottles 2 and 4; at night three pills from bottle 3 are to be taken together with one from bottle 1. Of course, if the quantity of pills to be taken is indicated on the pill bottle, then the user may limit himself to simply designating from which bottle he is to take pills by use of a single set number at each time period.

The user specifies on the sides of the box receptacle the complete regimen which he is following and wishes to monitor. The next step is to dispose the box in a convenient storage location, such as a shelf, so that only one face is principally viewable from a lateral direction as the user approaches the box. The face which is so disposed is that which designates the next time the user is to ingest pills. When the designated time arrives the user approaches the box, and severally removes and opens the bottles, and ingests the pills according to the markings on the face of the box for that time period. Afterwards he replaces the bottles in the box; he then rotates the box about its vertical axis so that the face now principally viewable is that indicating the next forthcoming time of scheduled ingestion.

Later, if the user forgets whether he has taken his scheduled pills, he simply approaches the box. If the face which is principally visible is that designating a present or past time period for which he is uncertain, then he proceeds to take the pills. If instead, the designation indicates a forthcoming period of scheduled ingestion, he is reminded that he has taken his pills and he retires until the next designated time arrives.

Various embodiments of the invention are presently within contemplation as being usable. The receptacle need not be a rectangular box and it may have more or fewer sides. It must be such that when the time period designations are affixed anyone can be made principally visible. By this is meant that the user readily perceives that which is singled out as the next designated time. Two times on the same side of the box or a circular box with closely spaced time designations would not enable sufficient distinction. It would be possible of course to have a movable marker on the box which visually demarked the next scheduled time. But the box or other device with no moving parts is preferred for simplicity and ease of use. The invention is adaptable as the following embodiments indicate. For example, for a weekly schedule, a box 28 may have seven sides as shown in FIG. 4. Alternately, the receptacle may be circular sided, so long as the time period labels or designators are spaced apart thereon sufficiently. Additionally, if the receptacle is a rectangular or many sided box as shown in FIG. 1, not all sides need be used. For instance, the rectangular box may be labeled only on two sides, such as two opposing sides, with the user rotating the box 180 degrees after each use. Another practice of the invention may involve a single dispensation made each day. For this may be used time period designations indicative of even and odd, to correspond with the several even and odd days of the month. The rotation of the box from the even to the odd side, etc. will be accomplished in company with a calendar.

In the preferred embodiment, the box is formed of a pleasant appearing wood, and the time period designation and pill container identifying tags are self-adhesive labels; new labels may be placed over old, or the adhesive may be of a familiar nature which allows easy removal. Also blank labels 24G, such as shown in FIG. 2, may be affixed over any label which is to be deleted. Of course other means, such as tape, pegs, magnets, fasteners, and the like may be used to affix a tag to the vessels or to the receptacle.

Preferably the same labels are also used to mark the vessels and the sides of the receptacle, but it should be evident that this not need be so to carry out the invention. There only need to be a readily discernible correlation between the markings, not an exact identity. Instead of numbers, markings such as letters, colors, shapes, graphic or ideographic symbols, and so forth may be used. Matching couples, pairs, or reciprocals may be used if desired. Of course, it is possible to emboss, shape, or otherwise characterize the vessel or its closure in a more permanent fashion, and to have tags for the box which correspond therewith. For example, a square bottle could correspond with a square label. Also, an alternate practice of the invention may be accomplished by simply marking the sides of the receptacle and the vessels with a writing instrument, although in many instances a lack of clarity will result.

A system may be included to provide for easier indication of multiple pills which are to be taken. One manner to accomplish this is to use subsets within the sets of labels or tags. In FIG. 6, a label 30 printed in reverse with the number "2" is shown; this correlates with the set of number "2" labels, one member 32 of which is shown in FIG. 5, printed in the conventional manner. In use, the reverse printed label 30 can be utilized to indicate a multiple of pills, such as five, compared to a single pill being indicated by the label 32 printed in the usual manner. Thus, if a person were to take seven pills of a certain type, the tags affixed to the side of the receptacle would be one reverse printed and two conventional printed. Another manner of designating a multiple quantities of pills can be achieved in accord with the configuration shown in FIGS. 7 and 8. The label 34 has, next to the number indicating the set, a space 36 provided for entry of a suffix indicating the quantity. This suffix can be entered by writing in the space provided or by supplemental labels. Alternately description or labels 38, of a different size or appearance from the principal set, may be affixed as subscripts to a standard label 40, as exemplified in FIG. 8, where consumption of four pills from bottle number 2 is indicated.

As mentioned the receptacle is preferably a simple open top box. But other devices may be used. A lid may be placed on the receptacle. The receptacle may be provided with rotational means, such as a "lazy susan" rotary bearing 42 shown in FIG. 9, interposed between the bottom of the box 20A and its rest surface 44.

In its general mode, the invention method comprises the use of the receptacle as an indicator and reminder. It is not necessary in the practice of the basic method of the invention that the vessels containing the pill articles be put in the receptacle; but this is a convenience and advantage. It is the rotation of the indicator device about any axis, to a time next scheduled, upon completion of the dispensation of the articles from their vessels, that fruitfully serves the user's purpose in monitoring his schedule. The receptacle type device is preferred because when the box must be removed for access to the pills, the person is forced to engage the device by which he is to be reminded. Contrast with this the circumstance where the reminder is separate from the stored pills: One is not forced to engage and set the reminder and if one is preoccupied, one can neglect doing so, whereupon the system will fail. Also, in the simplest use, it may not be necessary to indicate on the face of the indicator device the set of pills. That is, if one merely had one pill to take from the same set at anytime, then simple rotation of an indicator similar to the reminder device described herein would be satisfactory.

Although this invention has been shown and described with respect to a preferred embodiment, it will be understood by those skilled in this art that various changes in form and detail thereof may be made without departing from the spirit and scope of the claimed invention.

I claim:

1. Apparatus for monitoring the periodic dispensation of a plurality of articles contained in vessels, comprising a receptacle for receiving said vessels introduced along a vertical axis, the receptacle having sides and being adapted for selective rotation manually about the vertical axis, said sides having at least two designations of different time periods corresponding with the desired time of periodic dispensation of articles, the designations spaced apart so that by selective rotation of the receptacle only one of said designations may be made principally viewable from a lateral position for enabling periodic dispensation of articles, and said vessels contained within the receptacle, the vessels holding articles to be dispensed at one of the designated time periods on the side of the receptacle the vessels having individual marking tags which are different from each other, said individual marking tags also being affixed to the sides of the receptacle at the locations where the time designations appear.

2. The apparatus of claim 1 wherein the tags on the side of the receptacle by number, appearance and placement correspond with different quantities of articles scheduled to be dispensed at a designated time period.

3. The apparatus of claim 1 wherein the tags are paper and are affixed to the vessels and receptacle by a self-adhesive on the paper.

4. The apparatus of claim 1 or 2 wherein the tags have space for insertion of a descriptor indicating the number of articles to be dispensed at a time period.

5. The apparatus of claim 1 wherein the receptacle has mounting means which permit easy rotation of the receptacle about its vertical axis.

6. The apparatus of claim 1 wherein the receptacle is an open top box.

7. The apparatus of claim 6 wherein the box has four sides and wherein the time period designations are those corresponding to time within a day.

8. The method of dispensing pills and other articles which comprises marking at least one surface of a rotatable device with easily removable designations spaced apart in a manner such that only one designation may be made principally visible from a lateral direction, compared to the other designations; and, at a scheduled time of dispensing articles, selectively and manually rotating the device to a position such that the next scheduled time for dispensation is principally visible, inserting vessels containing the articles into the rotatable device; identifying the vessels with different markings; applying to the surface of the device markings corresponding with the different markings on the vessels, to indicate which articles are to be dispensed at the designated time; and at the scheduled time of dispensation, removing articles from the vessel according to the marking on the surface of the device.

* * * * *